US005278041A

United States Patent [19]

Murakami et al.

[11] Patent Number: 5,278,041

[45] Date of Patent: Jan. 11, 1994

[54] SILVER HALIDE COLOR PHOTOGRAPHIC LIGHT SENSITIVE MATERIAL

[75] Inventors: Shuji Murakami; Yukio Ohya; Tsuyoshi Ikeda; Shigeo Tanaka; Mitsuhiro Okumura, all of Hino, Japan

[73] Assignee: Konica Corporation, Tokyo, Japan

[21] Appl. No.: 859,801

[22] Filed: Mar. 30, 1992

[30] Foreign Application Priority Data

Apr. 3, 1991 [JP] Japan ..... 3-71172

[51] Int. Cl.[5] ..... G03C 1/08

[52] U.S. Cl. ..... 430/604; 430/567; 430/569; 430/605; 430/612

[58] Field of Search ..... 430/604, 569, 567, 605, 430/612

[56] References Cited

U.S. PATENT DOCUMENTS

| | | | |
|---|---|---|---|
| 4,183,756 | 1/1980 | Locker | 430/569 |
| 4,225,666 | 9/1980 | Locker et al. | 430/569 |
| 4,835,093 | 5/1989 | Janusonis et al. | 430/567 |
| 4,933,272 | 6/1990 | McDugle et al. | 430/604 |

FOREIGN PATENT DOCUMENTS

| | | |
|---|---|---|
| 0336425 | 10/1989 | European Pat. Off. . |
| 0336426 | 10/1989 | European Pat. Off. . |
| 0336427 | 10/1989 | European Pat. Off. . |
| 51-139323 | 12/1976 | Japan . |
| 55-26589 | 2/1980 | Japan . |
| 55-135832 | 10/1980 | Japan . |
| 58-9144 | 5/1983 | Japan . |
| 58-94340 | 6/1983 | Japan . |
| 58-95339 | 6/1983 | Japan . |
| 58-95736 | 6/1983 | Japan . |
| 58-106538 | 6/1983 | Japan . |
| 58-107531 | 6/1983 | Japan . |
| 58-107532 | 6/1983 | Japan . |
| 58-107533 | 6/1983 | Japan . |
| 58-108533 | 6/1983 | Japan . |
| 58-125612 | 7/1983 | Japan . |
| 59-171947 | 9/1984 | Japan . |
| 1-183647 | 7/1989 | Japan . |
| 2-20852 | 1/1990 | Japan . |
| 2-20853 | 1/1990 | Japan . |
| 2-020855 | 1/1990 | Japan . |
| 2-20855 | 1/1990 | Japan . |

OTHER PUBLICATIONS

Patent Abstracts of Japan, vol. 9, No. 026 (p-332) 5 Feb. 1985 & JP-A-59 171 947 (Konishiroku Shashin Kogyo KK) (28 Sep. 1984).

*Primary Examiner*—Charles L. Bowers, Jr.
*Assistant Examiner*—Thorl Chea
*Attorney, Agent, or Firm*—Frishauf, Holtz, Goodman & Woodward

[57] ABSTRACT

A silver halide color light-sensitive material is disclosed. The light-sensitive material comprises a support and a silver halide emulsion layer provided on the support. The emulsion layer comprises silver halide grains which have been formed in the presence of a complex of rhenium, molybdenum, iridium, rhodium, ruthenium, osmium, cadmium, zinc, palladium, platinum, gold, iron, nickel, cobalt, tungsten, or chromium each having at least one cyanate ligand, isocyanate ligand or fluminate ligand. The light-sensitive material is high in speed, low in fog and excellent in reciprocity low failure characteristics.

10 Claims, No Drawings

SILVER HALIDE COLOR PHOTOGRAPHIC LIGHT SENSITIVE MATERIAL

FIELD OF THE INVENTION

This invention relates to a silver halide photographic light sensitive material and, particularly, to a silver halide color photographic light sensitive material high in photosensitive speed and excellent in reciprocity law failure characteristics.

BACKGROUND OF THE INVENTION

In recent years, light sensitive materials for color print paper have been so demanded as to be rapidly processed for the purpose of expediting the deliveries of a large quantity of prints. As one of the techniques for accomplishing the purpose, there have been the known attempts for making a color development rapid by making use of a silver chloride emulsion or a silver chlorobromide emulsion having a high silver chloride content as a silver halide emulsion to be used in the light sensitive materials for color print paper. The above-mentioned techniques are described in, for example, U.S. Pat. Nos. 4,183,756 and 4,225,666 and Japanese Patent Publication Open to Public Inspection (hereinafter abbreviated to as JP OPI Publication) Nos. 55-26589/1980, 58-91444/1983, 58-95339/1983, 58-94340/1983, 58-95736/1983, 58-106538/1983, 58-107531/1983, 58-107532/1983, 58-107533/1983, 58-108533/1983 and 58-125612/1983.

However, the above-mentioned silver chloride emulsion or silver chlorobromide emulsion having a high silver chloride content has had the defects that the photosensitive speed is low and the reciprocity law failure is large, namely, the photosensitive speed and gradation are seriously varied by exposure illuminance. For solving the above-mentioned defects, there have been various attempts. For example, JP OPI Publication Nos. 51-139323/1976 and 59-171947/1984 describe each that a processing stability and reciprocity law failure characteristics can be improved by containing the metal compounds belonging to Group VIII of Periodic Table in a light sensitive material.

In the techniques disclosed therein, however, it has been not satisfactory to solve the above-mentioned problems of the silver chloride or the silver halide having a high silver chloride content. In the meanwhile, JP OPI Publication No. 1-183647/1989 describes that, when iron ions are contained in silver halide having both of a silver bromide containing phase having a high silver bromide content and a high silver chloride content, a photosensitive speed can be increased, the reciprocity law failure characteristics can be improved, and the photosensitive speeds and gradations varied by the temperatures varied by exposing a light sensitive material to light can also be improved.

However, the technique still has another serious problem in latent image stability that a photosensitive speed is seriously varied by the intervals between an exposure and a processing treatment, though the above-mentioned problems may nearly be solved. Besides the above, JP OPI Publication No. 55-135832/1980 describes that a high-speed emulsion can be prepared by doping cadmium, lead, copper or zinc therein. According to the studies made by the present inventors, it was proved that this technique cannot make a photosensitive speed higher and improve the reciprocity law failure at the same time satisfactorily. JP OPI Publication No. 2-20852/1990 discribes on a silver halide emulsion containing the complexes of a transition metal having a nitrosyl or thionitrosyl ligand, but not particularly describes on any increase of photosensitive speeds. Further, JP OPI Publication Nos. 2-20853/1990 and 2-20855/1990 describe on the complexes having each a cyano ligand which are capable of making a photosensitive speed higher. However, when these complexes are used, there is a serious environmental problem, because the cyano ligands are severely toxic and it is further proved to be unsatisfactory to make any photosensitive speeds higher and to improve any reciprocity law failure characteristics.

SUMMARY OF THE INVENTION

It is an object of the invention to provide a silver halide color photographic light sensitive material high in photosensitive speed, low in fog production and excellent in reciprocity law failure characteristics.

The above object of the invention can be achieved with a silver halide color photographic light-sensitive material comprising a support having thereon a silver halide emulsion layer containing silver halide grains which have been formed in the presence of a complex of rhenium, molybdenum, iridium, rhodium, ruthenium, osmium, cadmium, zinc, palladium, platinum, gold, iron, nickel, cobalt, tungsten, or chromium each having at least one cyanate ligand, isocyanate ligand or fulminate ligand.

DETAILED DESCRIPTION OF THE INVENTION

In the invention, the expression, ". . . silver halide grains are formed in the presence of a complex . . . ", means that a complex may be made present in advance in a kettle before the grains are formed or may be added continuously or collectively in the course of forming the emulsion grains.

In the silver halide color photographic light sensitive materials of the invention, the grains preferable for displaying the effects of the invention include, for example, the grains not substantially containing any iodide, and the silver chloride contents thereof preferable for displaying the effects of the invention are not less than 95 mol % and, preferably, within the range of 98 to 99.9 mol %.

In the invention, silver chlorobromide having a silver bromide content within the range of 0.1 to 2 mol % can preferably be used. As for the silver halide grains relating to the invention, those having a uniform composition may be used or they may be used in combination with other silver halide grains having the different composition.

In a silver halide emulsion layer containing silver halide grains having a silver chloride content of not less than 90 mol %, the silver halide grains having the silver chloride content of not less than 90 mol % are contained in a proportion of, desirably, not less than 60 mol % and, preferably, not less than 80 mol % of the whole silver halide grains contained in the emulsion layer.

When forming the silver halide grains, the complexes are to be made present in an amount within the range of $1\times10^{-9}$ to $1\times10^{-2}$ mols and, preferably, $1\times10^{-6}$ to $1\times10^{-4}$ mols per mol of silver.

The metals desirably applicable to the complexes to be contained in the silver halide grains of the invention include, for example, rhenium, ruthenium, osmium, iron and palladium, and the metals preferably applicable thereto include, for example, osmium, rhenium, ruthenium and iron.

In the complex compounds of the invention which are to be doped in the silver halide grains of the invention, the counter ions thereof do not play any important role for achieving the objects of the invention, because the counter ions thereof are dissociated in an aqueous solution. The examples of the complex compounds (I) of the invention which are to be doped in the silver halide grains of the invention will now be given below. The examples thereof shall not, however, be limited to the following examples thereof.

| Compounds (I) | |
|---|---|
| (1) $[Ru(CNO)_6]^{4-}$ | (2) $[Os(CNO)_6]^{4-}$ |
| (3) $[OsO_2(CNO)\text{-}4]^{2-}$ | (4) $[Rh(CNO)_6]^{3-}$ |
| (5) $[Ir(CNO)_6]^{3-}$ | (6) $[Zn(CNO)_4]^{2-}$ |
| (7) $[Cd(CNO)_4]^{2-}$ | (8) $[Pd(CNO)_4]^{2-}$ |
| (9) $[Pt(CNO)_4]^{2-}$ | (10) $[Ni(CNO)_4]^{2-}$ |
| (11) $[Au(CNO)_2]^{-}$ | (12) $[Cr(CO)_4(CNO)_2]^{2-}$ |
| (13) $[Mo(CO)_4(CNO)_2]^{2-}$ | (14) $[W(CO)_4(CNO)_2]^{2-}$ |
| (15) $[Co(CNO)_6]^{3-}$ | (16) $[Co_2(CNO)_{11}]^{5-}$ |
| (17) $[Fe(CNO)_6]^{4-}$ | (18) $[Fe(CN)_5CNO]^{4-}$ |
| (19) $[Cr(CO)_5CNO]^{-}$ | (20) $[Pt(CNO)_2Br_2]^{2-}$ |
| (21) $[Mo(OCN)_6]^{3-}$ | (22) $[Re(CNO)_6]^{3-}$ |
| (23) $[Re(OCN)_6]^{4-}$ | (24) $[Re(NCO)_6]^{3-}$ |
| (25) $[Ru(NCO)_6]^{3-}$ | (26) $[Ru(NCO)_6]^{4-}$ |
| (27) $[Os(NCO)_6]^{3-}$ | (28) $[Os(OCN)_6]^{3-}$ |
| (29) $[Fe(NCO)_6]^{3-}$ | (30) $[Fe(OCN)_6]^{3-}$ |

It is preferable that the grains of the invention are to be subjected to the gold-sensitization which have been commonly known.

The silver halide photographic light sensitive materials relating to the invention may be desirably applied with a variety of sensitizing dyes, water-soluble dyestaffs, anti-color-foggants, image stabilizers, hardeners, plasticizers, polymer latexes, UV absorbents, formalin scavengers, mordants, development accelerators, development retarders, fluorescent whitening agents, matting agents, lubricants, antistatic agents and surfactants.

In the silver halide photographic light sensitive materials relating to the invention, a variety of well-known supports can be used, for example; paper-made supports such as baryta paper or a paper laminated with α-olefin polymer and a paper-made support readily peelable from an α-olefin layer; flexible reflective supports such as those made of synthetic paper; and those made of cellulose acetate, cellulose nitrate, polystyrene or polyvinyl chloride.

The silver halide light sensitive materials of the invention are suitable for a light sensitive material for providing an image formed by making a scanning-exposure and, particularly, for a light sensitive material for providing an image formed by controlling an exposure time for controlling an exposure quantity, because the light sensitive materials of the invention are high in sensitive speed and few in reciprocity law failure. The well-known methods for making a hard copy from an image information recorded on a magnetic medium include, for example, a method in which an image is formed by scanning the light sensitive surface of a light sensitive material with a beam of light modulated by an image signal.

When a color image is to be formed by a scanning exposure, the conventional silver halide color photographic light sensitive materials have had the problem to unable to obtain any light source suitable for making a record, because the light sensitive materials comprise silver halide emulsion layers sensitive to blue, green and red rays of light, respectively. For example, when such a conventional silver halide photographic light sensitive material is exposed by light, baam-scanning there have commonly used so far a gas-laser such as those of helium, neon, argon ions and helium.cadmium. However, these lasers have had the defects such as the size is large, the cost is expensive and the life is short, substantially. In the meanwhile, there is a known method in which a semiconductive laser and a non-linear optical element are used. However, this method has had a problem that the conversion efficiency is not satisfactory.

The above-mentioned problems can be solved when making use of a silver halide emulsion sensitive to infrared rays of light and thereby an inexpensive and small sized exposure means can be provided when a semiconductive laser. With regard to the silver halide photographic light sensitive materials each comprising a silver halide photographic emulsion layer sensitive to infrared rays of light, JP OPI Publication No. 61-137149/1986, for example, discloses the basic constitutional requirements which are to be satisfied by a silver halide photographic light sensitive material comprising a plurality of silver halide photographic emulsion layers each sensitive to the different infrared wavelength regions. However, this particular patent publication does not describe the problems concerning any exposure systems.

As compared to the gas-lasers, the semiconductive lasers are superior in rise-time characteristics and have the characteristics that a laser output can immediately be obtained when an electric current is applied thereto. In the means comprising a gas-laser, an acoustic optical modulation element (AOM) are commonly used for modulating a light intensity according to an image data. However, when making the beams of light incident to the element, the beams should be narrowed and an optical system having a lens and a mirror should therefore be provided. When a semiconductive laser is used together with the above-mentioned optical system, the advantages of the semiconductive laser, such as compactness in size and inexpensiveness in cost, are lost. For the above-mentioned reasons, it is usual in the case of using a semiconductive laser to control an electric current applied to the semiconductive laser without making use of any special element such as AOM. However, a semiconductive laser has a sharp light intensity variation produced by the variations of an electric current applied to the laser and, therefore, the light intensity can hardly be controlled precisely.

The above-mentioned problems can be solved in the manner that an exposure quantity is controlled by controlling an exposure time or an exposure quantity is controlled by changing a light intensity stepwise and at the same time by controlling an exposure time. However, in a scanning exposure system in which a laser is used a the light source thereof, there may be some instances where an exposure time may be so shortened that the exposure time may be some nanoseconds when an exposure quantity is controlled by controlling the exposure time, because the original exposure time per pixel is exceedingly short.

Silver halide photographic light sensitive materials generally have the characteristics of seriously lowering an image forming efficiency when making a short-time exposure, that has been known as a reciprocity law failure. In addition to the above, when making an exposure for a short time of microseconds or shorter, not only the characteristics thereof may be so varied as to lower the sensitive speed or to soften the gradation, but also the phenomena may be so presented as to bend the characteristic curve and sharply vary the inclinations of the curve at a certain boundary point. It has already been proved that the shorter an exposure time is, the more the phenomena are presented apparently.

In an image forming system in which a scanning exposure is carried out according to a digitalized image data, it has so far been considered that a light quantity may be so controlled as to obtain a desired density. Therefore, the above-mentioned phenomena have not been regarded as problems. In an exposure time controlling system, however, the exposure quantity is controlled by controlling an exposure time, which causes a variation in a sensitive speed of the light-sensitive material used in the system. Therefore, sometimes, exceedingly complicated variations have been produced when any other variation factors, such as atmospheric temperature and humidity at the time when making an exposure, are factors. Such a variation as mentioned above has been more remarkably produced in such a system that an exposure quantity is controlled by controlling both of an exposure time and a light intensity in combination. In the course of practically forming an image, the above-mentioned problems come to a head in the form that reproducibility deteriorates when one and the same image is outputted repeatedly; otherwise a color doubling or an image blur is produced in an image.

Even when the light sensitive materials of the invention are each exposed to light in a scanning exposure system in which an exposure quantity is controlled by controlling an exposure time for some nanoseconds, any image formation can be performed without producing the above-mentioned problems.

The silver halide color photographic light sensitive materials relating to the invention comprise each a layer containing a silver halide emulsion spectrally sensitized to a specific wavelength region within the range of 400 to 900 nm in combination with a yellow coupler, a magenta coupler and a cyan coupler. Such a silver halide emulsion as mentioned above contains one or plural kinds of sensitizing dyes in combination.

In the case of making an exposure through a semiconductive laser, a spectral sensitization is so carried out as to conform with the emission wavelength of a semiconductive laser used. The emission wavelengths of most semiconductive lasers are in a red to infrared wavelength region. Therefore, a silver halide emulsion sensitive to red to infrared rays may preferably be used.

The typical compounds for the infrared sensitizing dyes preferably applicable to the invention (IRS-1 through IRS-11) and the typical compounds for the super sensitizers (SS-1 through SS-9) applicable thereto in combination will be given below.

IRS-1

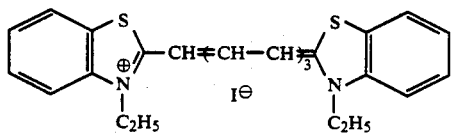

IRS-2

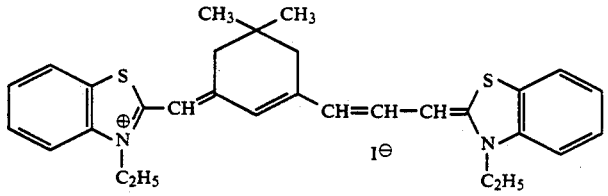

IRS-3

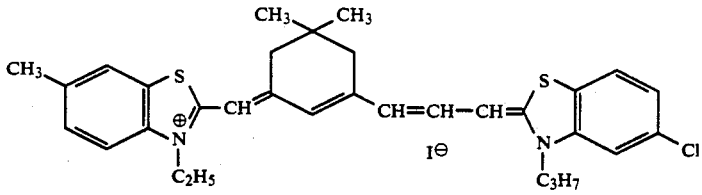

IRS-4

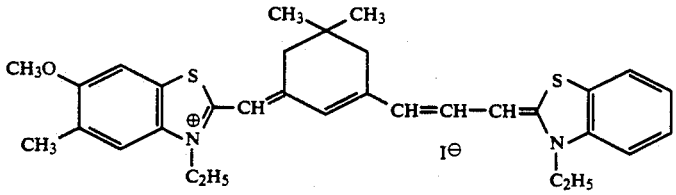

IRS-5

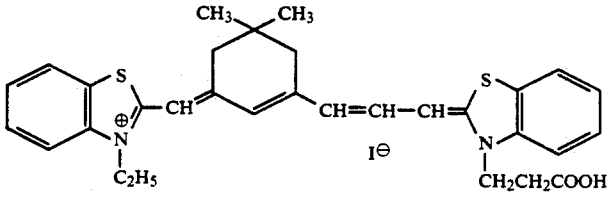

-continued
IRS-6
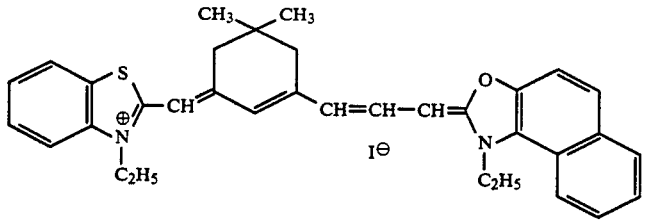
IRS-7
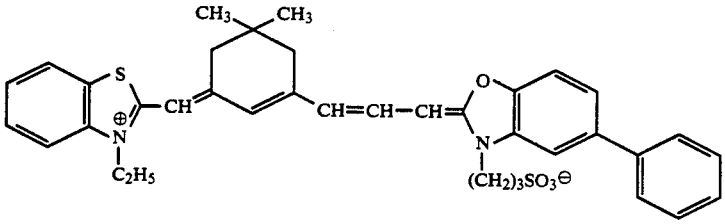
IRS-8
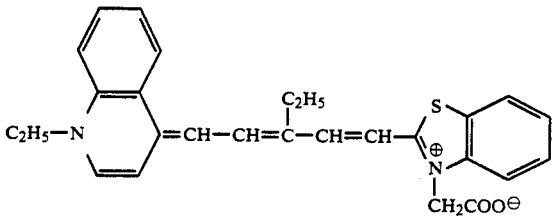
IRS-9
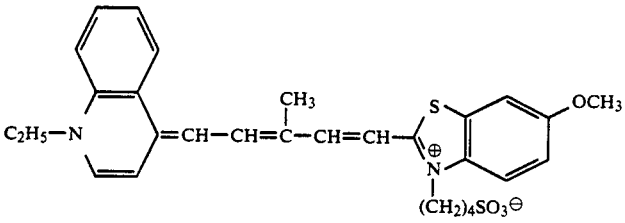
IRS-10
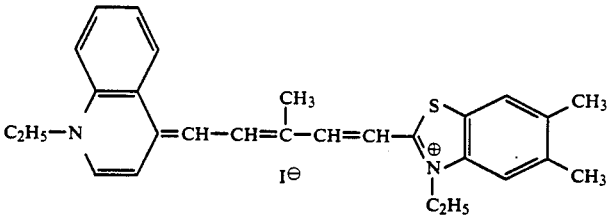
IRS-11
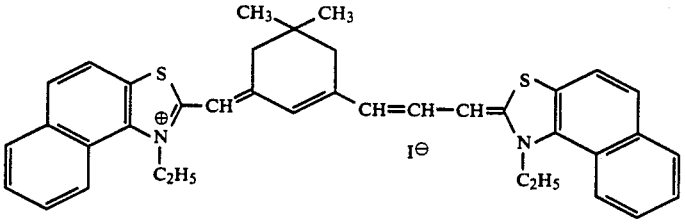
SS-1
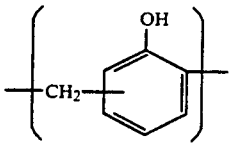

-continued
SS-2
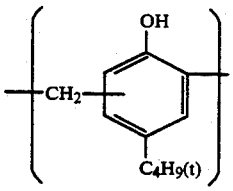
SS-3
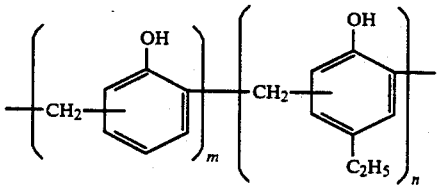
m:n = 15:5
SS-4
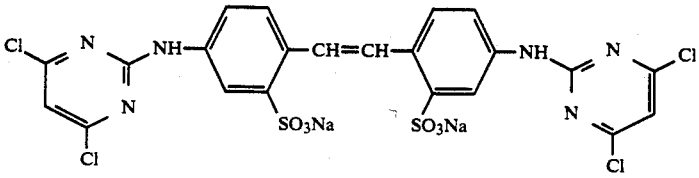
SS-5
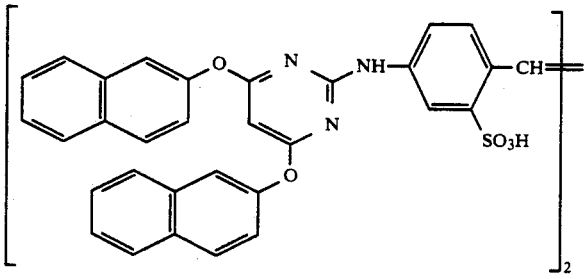
SS-6
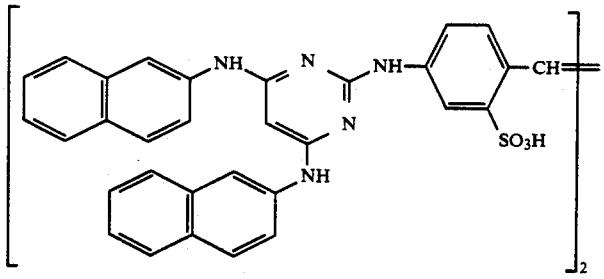
SS-7
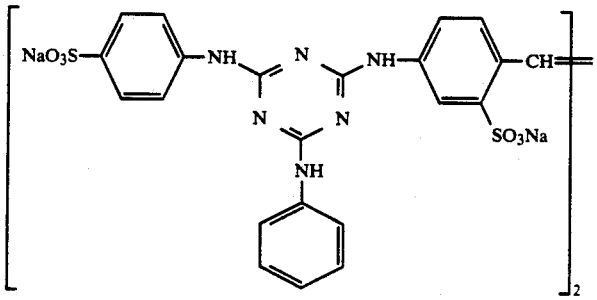

-continued

SS-8

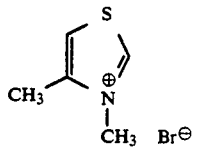

SS-9

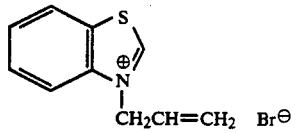

The silver halide photographic light sensitive materials relating to the invention may be applied with the dyes each having an absorption in various wavelength regions, for the purpose of preventing an irradiation and a halation. Also for this purpose, any one of the known compounds may be applied thereto. The infrared-ray absorbing dyes include, for example, the compounds represented by Formulas (I), (II) and (III) given in the lower column of page 2 of JP OPI Publication No. 1-280750/1990, because these compounds have the desirable spectral characteristics without affecting any photographic characteristics of a silver halide photographic emulsion nor producing any residual color stains. The typical examples of the preferable compounds include the exemplified compounds (1) through (45) given in the lower left column of page 3 to the lower left column of page 5 of the same JP OPI Publication as given above.

In the silver halide photographic light sensitive materials relating to the invention, the couplers applicable thereto also include any compounds capable to providing a coupling product produced in a coupling reaction with the oxidized products of a color developing agent so as to have a maximum spectral absorption wavelength in a wavelength region longer than 340 nm. The typical compounds thereof include, for example, a yellow coupler having a maximum spectral absorption wavelength in the wavelength region within the range of 350 to 500 nm, a magenta coupler having a maximum spectral absorption wavelength in the wavelength region within the range of 500 to 600 nm and a cyan coupler having a maximum spectral absorption wavelength in the wavelength region within the range of 600 to 750 nm.

In the silver halide photographic light sensitive materials relating to the invention, the yellow couplers desirably applicable thereto include, for example, those represented by the following Formula (Y-1). The typical examples thereof include the following compounds YC-1 through YC-9. Among them, YC-8 and YC-9 are each preferably applicable thereto, because they can reproduce yellow color having a desirable tone.

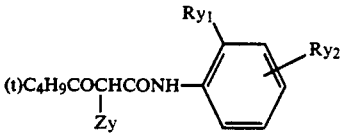

wherein $R_{y1}$ represents an alkoxy group; $R_{y2}$ represents $-NHCOR_{y3}SO_2R_{y4}$, $COOR_{y4}$, $-NHCOR_{y4}$, $-COOR_{y3}COOR_{y4}$, $-N(R_{y5})SO_2R_{y4}$ or $-SO_2N(R_{y5})R_{y4}$, in which $R_{y3}$ represents an alkylene group, $Y_{y4}$ represents a ballast group and $R_{y5}$ represents a hydrogen atom, an alkyl group or an aralkyl group; and $Z_y$ represents a coupling-off group.

YC-1

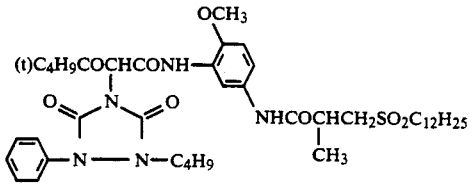

YC-2

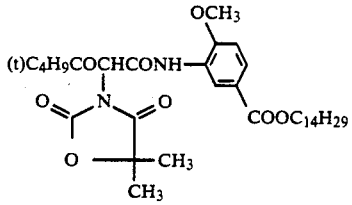

YC-3

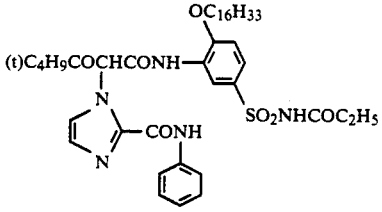

YC-4

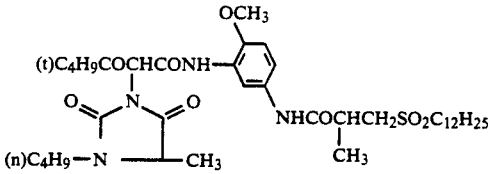

YC-5

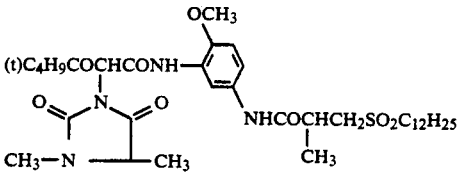

YC-6

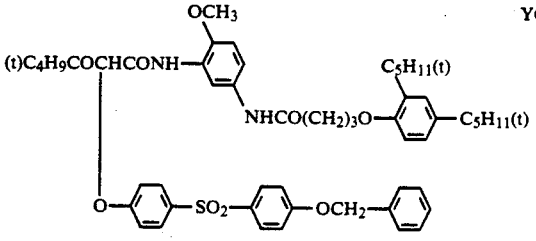

-continued

YC-7

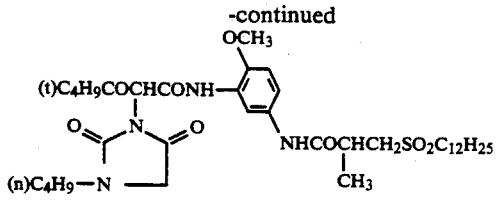

YC-8

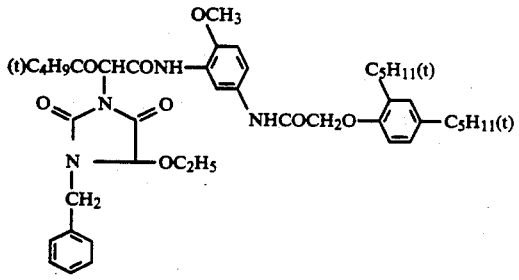

YC-9

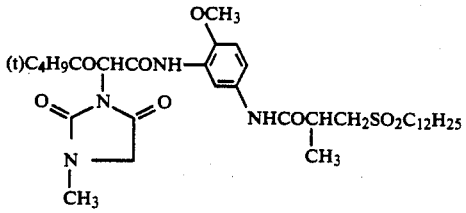

In the silver halide photographic light sensitive materials relating to the invention, the magenta couplers desirably applicable thereto include, for example, those represented by Formulas (M-I) and M-II) given in page 12 of JP Application No. 2-234208/1991. The typical compounds thereof include, for example, MC-1 through MC-11 given in pages 13 through 16 of the same JP Application as given above. Among them, MC-8 through MC-11 given on pages 15 through 16 of the same JP Application are preferably used, because they are excellent in color reproduction from blue to purple and red and in detailed color description.

In the silver halide photographic light sensitive materials relating to the invention, the cyan couplers desirably applicable thereto include, for example, those represented by Formulas (C-I) through (C-II) given on page 17 of JP Application No. 2-234208/1991. The typical compounds thereof include, for example, CC-1 through CC-14 given on pages 18 through 21 of the same JP Application.

It is preferable to form a color image having an excellent color and gradation reproduction in the following color image forming process. A silver halide photographic light sensitive material comprising a reflective support bearing thereon a silver halide emulsion layer containing a yellow coupler, a magenta coupler and a cyan coupler is exposed to light with scanning and is then developed. When the image density of the yellow color patch resulted in the above-mentioned color image forming process becomes 2.0, the metric hue angle is to be within the range of not narrower than 86° and not wider than 90° and the metric chroma is to be not less than 85 in terms of CIE 1976 L*a*b* color space and when the image density of the magenta color patch resulted in the above-mentioned color image forming process becomes 2.0, the metric hue angle is to be within the range of not narrower than 340° and not wider than 355° and the metric chroma is to be not less than 70, in terms of CIE 1976 L*a*b* color space, each in the resulting chromaticity.

When satisfying the following requirements; both of an exposure quantity to a silver halide emulsion layer containing a yellow coupler and an exposure quantity to a silver halide emulsion layer containing a magenta coupler are the exposure quantities each capable of providing a high density image; and an exposure quantity to a silver halide emulsion layer containing a cyan coupler is an exposure quantity capable of providing a cyan image having a image density of not higher than 0.5; the resulting color image can be excellent when the silver halide emulsion layer containing the cyan coupler is subjected to a scanning exposure in an exposure quantity so calculated out as to form an image having a contrast higher than that of an image formed on a silver halide emulsion layer containing a cyan coupler when the above-given requirements cannot be satisfied.

The above-mentioned metric hue angles may be found out in the following manner. After coating photographic component layers including a silver halide emulsion layer containing a coupler over a reflective support having a flat and smooth surface, the resulting coated layer is exposed to light having a suitable spectral composition and is then developed, so that a color patch may be obtained. And, the spectral absorption of the resulting color patch is measured, so that the metric hue angles can be found out. The spectral absorption is measured under the requirement c of the geometrical illumination and light acceptance requirements, and tristimulus values, X, Y and Z, are obtained in the method described in JIS Z-8722 (1982). And, each of L* a* b* values are then obtained in the method described in JIS Z-8729 (1980). A metric hue angle of a color which is represented by point A, is defined as, on an a* b* plane in CIE 1976 L* a* b* color space. A metric hue angle of a color which is represented by a point A, is defined as an angle which is formed by a line A-origin and a* axis on a* b* plane in CIE 1976 L* a* b* color space. In the case of $a^*>0$ and $b^*>0$, the metric hue angle is to be within the range of 0° to 90° and in the case of $a^*>0$ and $b^*<0$, it is to be within the range of 270° to 360°. A metric.chroma is defined as a distance from an L* axis in CIE 1976 L* a* b* color space. For the details thereof, Yoshinobu Naya, "Industrial Chromatics", pp. 106–107, Asakura Shoten, 1989, for example, may be referred. The above-mentioned image density can be found out by measuring the density of a color patch through a densitometer satisfying the spectral requirements of Status A specified in JIS K 7653-1988 and the geometric requirements specified in JIS K 7654-1990.

It is preferable to satisfy the regurements that, when the image density of the yellow color patch becomes 2.0, the metric hue angle is to be within the range of not narrower than 86° and not wider than 90° and the metric chroma is to be not less than 85 and when the image density of the magenta color patch becomes 2.0, the metric hue angle is to be within the range of not narrower than 340° and not wider than 355° and the metric chroma is to be not less than 70, each in terms of CIE 1976 L*a*b* color space in the resulting chromaticity.

The metric hue angles and metric.chroma of a yellow or magenta image can be mainly determined by the structures of a yellow or magenta imaging dye. Therefore, the structures of a yellow coupler, a magenta coupler and a color developing agent and, particularly, the structures of the yellow and magenta couplers, have the greatest influence on whether the above-mentioned metric hue angles and the metric.chroma can be obtained or not. However, besides the above, an additive capable of shifting the spectral absorption of a imaging dye to either a long wavelength side or a short wavelength side upon forming a intermolecular hydrogen bond, the kinds and quantities of a high boiling organic solvent and a polymer each applicable to a coupler dispersion treatment, the quantitative ratios of a coupler to a high boiling organic solvent and the amount of a coupler dispersion coated have each an influence thereon, though they have a relatively few influence.

It is necessary to satisfy the requirements that, when the image density of a yellow color patch becomes 2.0, the metric hue angle is to be within the range of not narrower than 86° and not wider than 90° and the metric chroma is to be not less than 85, (hereinafter referred to as Requirements Y). It is, however, preferable to satisfy the requirements that, when the image density of the yellow color patch becomes 2.0, the metric hue angle is to be within the range of not narrower than 87° and not wider than 89° and the metric chroma is to be not less than 85. The yellow couplers preferably capable of forming a yellow image satisfying Requirements Y include, for example, those already given above.

Even if a yellow coupler is independently incapable of forming a yellow image satisfying the above-mentioned Requirements Y and if the yellow coupler can satisfy the same Requirements when it is used with other couplers in combination, such yellow couplers can also be used in the silver halide photographic light sensitive materials relating to the invention.

It is preferable to satisfy the requirements that, when the image density of a magenta color patch becomes 2.0, the metric hue angle is to be within the range of not narrower than 340° and not wider than 355° and the metric chroma is to be not less than 70, (hereinafter referred to as Requirements M). It is, however, more preferable to satisfy the requirements that, when the image density of the magenta color patch becomes 2.0, the metric hue angle is to be within the range of not narrower than 345° and not wider than 350° and the metric chroma is to be not less than 70. The typical magenta couplers preferably capable of forming a magenta image satisfying Requirements M include, for example, those given below.

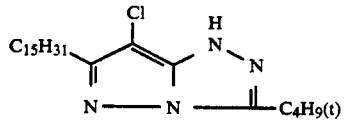
MC-1

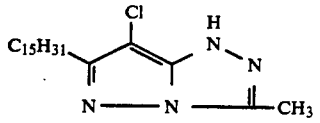
MC-2

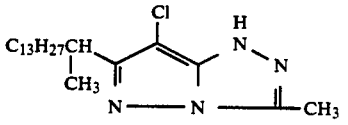
MC-3

-continued

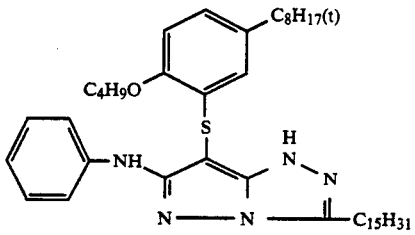
MC-4

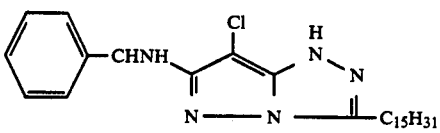
MC-5

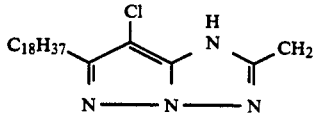
MC-6

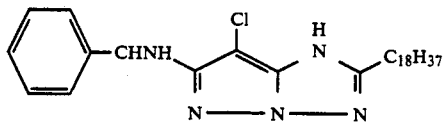
MC-7

Even if a magenta coupler is independently incapable of forming a magenta image satisfying the above-mentioned Requirements M and if the magenta coupler can satisfy Requirements M when it is used with other couplers in combination, such magenta couplers can also be used in the silver halide photographic light sensitive materials relating to the invention.

In the case of making use of a water-in-oil drop type emulsification dispersion method for adding a coupler relating to the invention into a silver halide photographic light sensitive material, it is usual to dissolve the coupler in a water-insoluble high boiling organic solvent and, if required, a low boiling and/or a water-soluble organic solvent in combination, and the resulting coupler solution is emulsified and dispersed in a hydrophilic binder such as an aqueous gelatin solution by making use of a surfactant. As for the dispersing means, a stirrer, a homogenizer, a colloid-mill, a flow-jet mixer and a supersonic disperser may be used. It is also allowed to add a processing step of removing the low boiling organic solvent either after or at the same time when the coupler is dispersed. The high boiling organic solvents applicable thereto for dissolving and dispersing a coupler include, for example, the following solvents.

(1) Dioctyl phthalate,
(2) Dinonyl phthalate,
(3) Diisododecyl phthalate,
(4) Dicyclohexyl phthalate,
(5) Tricresyl phosphate,
(6) Trihexyl phosphate,
(7) Tri(2-ethylhexyl) phosphate,
(8) Diethyl lauramide,
(9) Dinonyl phenol,
(10) Dekalin, and
(11) 1,4-bis(2-ethylhexylcarbonyloxymethyl)cyclohexane The weight ratio of a high boiling organic solvent to a coupler is to be within the range of, desirably, 0.1 to 2 parts by weight of the high boiling organic solvent per 1 part by weight of the coupler and, preferably, 0.2 to 1 parts by weight of the high boiling organic solvent per 1 part by weight of the coupler. The higher the ratio by weight of a high boiling organic solvent is, the more a preferable spectral absorption can readily be obtained. However, it is disadvantageous from the viewpoints of the stability of a silver halide light sensitive material and the resistance against physical damages. Therefore, the above-mentioned ratio by weight is to be determined by taking the balance of the above-mentioned factors into consideration.

Instead of the methods of making use of a high boiling organic solvent, it is also allowed to use a method that a coupler and a water-insoluble and organic solvent-soluble polymer compound are dissolved, together with a low boiling and/or water-soluble organic solvent if required, and the resulting solution is emulsified and dispersed in a hydrophilic binder such as an aqueous gelatin solution by making use of a surfactant through one of various dispersing means. The above-mentioned water-insoluble and organic solvent-soluble polymers applicable thereto include, for example, the following compounds.

[PO-1] Poly(N-t-butyl acrylamide),

[PO-2] N-t-butyl acrylamide-methyl methacrylate copolymer, (60:40),

[PO-3] Polybutyl methacrylate,

[PO-4] Methyl methacrylate-styrene copolymer, (90:10),

[PO-5] N-t-butyl acrylamide-2-methoxyethyl acrylate copolymer, (55:45),

[PO-6] ω-methoxypolyethylene glycol acrylate (addition mol number n=9) -N-t-butyl acrylamide copolymer, (25:75),

[PO-7] 1,4-butane diol-adipic acid polyester, and

[PO-8] Polypropiolactam wherein the parenthesized numerical values of the copolymers indicate each a weight ratios of the monomers.

For the purpose of shifting the absorption wavelengths of color developing dyes, the a compound such as the following may be used.

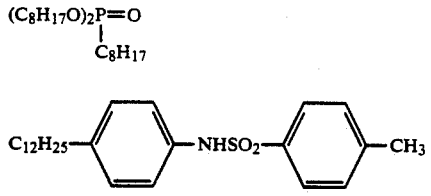

Besides the above-given compounds, it is also allowed to use the fluorescent dye-releasing compounds given in U.S. Pat. No. 4,774,187.

There is no special limitation to the amounts of couplers to be coated, provided that a satisfactorily high density can be obtained. However, the couplers may be used in an amount within the range of, desirably, $1\times10^{-3}$ mols to 5 mols per mol of silver halide used and, preferably, $1\times10^{-2}$ mols to 1 mol.

In the case where a silver halide photographic light sensitive material relating to the invention is a full-color photographic light sensitive material, an exposure means to be used in this case is to have three light sources adjusted to the light sensitive regions of three emulsions incorporated with yellow, magenta and cyan couplers, respectively. As for the light sources thereof, semiconductive lasers may be used and, besides, gas-lasers may also be used in combination.

For making such a means smaller in size and saving the cost, it is preferable to use semiconductive lasers for all the three light sources.

Any one of the semiconductive lasers may be used, provided that they have a satisfactory intensity. These lasers include, for example, those of AlGaInP, GaAsP, AlGaAs, InGaAsP, and AlGaAsSb. Among these lasers, the semiconductive lasers of 670, 750, 780, 810, 830 and 880 nm can advantageously be used from the viewpoints of a light intensity and handling silver halide light sensitive materials.

In the case where a scanning exposure is made by a laser beam, an exposure time per pixel is defined as (the diameter of a luminous flux)/(a scanning rate), provided, in the spatial variations of a luminous flux intensity, the outer edge of the luminous flux is regarded as the point where the light intensity becomes one half of the maximum intensity and the diameter of the luminous flux is regarded as the distance between the two points intersecting the line parallel to a scanning line passing through a point having a maximum light intensity and the outer edge of the luminous flux each other. When making use of a exposure means capable of exposing with a short exposure time per pixel, the light-sensitive materials of the invention becomes particularly effective.

The laser printers which may be acceptable to such as system as mentioned above are described in, for example; JP OPI Publication Nos. 55-4071/1980, 59-11062/1984, 63-197947/1988, 2-74942/1990 and 2-236538/1990; JP Examined Publication Nos. 56-14963/1981 and 56-40822/1981; European Patent No. 77410; The Technical Report, Vol.80, No.244, The Institute of Electronics and Communication Engineers of Japan; and The Motion Picture & TV Engineering, 1984/6, (382), pp. 34–36.

A yellow coupler-containing silver halide emulsion layer, a magenta coupler-containing silver halide emulsion layer and a cyan coupler-containing silver halide emulsion layer are to be subjected to a scanning exposure in an exposure quantity controlled by a signal output in accordance with the data of controlling the exposure quantities of each of the layers, which are recorded on a magnetic recording medium. In this case, an output image can be converted into any desired image, when processing a signal output according to the above-mentioned data.

It is possible to improve the gradation reproducibility of a high chroma red image by changing the amount of light to which the cyan coupler-containing silver halide emulsion layer is exposed, depending upon whether satisfying or not the conditions that; the signals for controlling the exposure quantities applied respectively to a yellow coupler-containing silver halide emulsion layer and a magenta coupler-containing silver halide emulsion layer are both to be converted into the signals for providing a high density yellow image and a high density magenta image, respectively, and the signal for controlling the exposure quantities applied to a cyan coupler-containing silver halide emulsion layer is to be converted into a signal for providing a cyan image having a density of not higher than 0.5.

To be concrete, signals for controlling the amount of light to which the cyan coupler-containing silver halide emulsion layer is exposed have only to be controlled for operation so that the contrast of cyan images in the case of the satisfied aforementioned conditions may be higher compared with that on the occasion when those conditions are not satisfied.

The lower limit values of densities of yellow images and magenta images both obtained through the aforementioned processing can be determined properly, for example, to 1.0 or 1.5, according to the outputted images.

The signal for controlling the exposure quantity applied to the cyan coupler-containing silver halide emulsion layer can be calculated in an analog or digital system.

In the development process of the silver halide color photographic light sensitive materials relating to the invention, the color developing agents applicable to the color developers include, for example, an aminophenol type and p-phenylenediamine type compounds which have widely been used in various color photographic processes. Among them in particular, an aromatic primary amine type color developing agent is preferably used. In addition to the above-mentioned color developing agents, the compounds already known as the components of the developers may also be added to the color developers.

The silver halide photographic light sensitive materials relating to the invention are color-developed and are then bleached and fixed. The bleaching treatment is also allowed to be performed together with the fixing treatment at the same time. After completing the fixing treatment, a washing treatment is commonly carried out. It is further allowed to carry out a stabilizing treatment in place of the washing treatment. Both of the washing and stabilizing treatments may be carried out in combination. The developing apparatuses for developing the silver halide photographic light sensitive material of the invention include, for example, that of the roller-transport type which transports a light sensitive material sandwiched between the rollers arranged into a processing tank, that of the endless-belt system which transports a light sensitive material fixed to the belt and that of the system in which a processing tank is specially produced in the slit-shape and a processing solution is supplied into the processing tank and, at the same time, a light sensitive material is transported.

EXAMPLES

EXAMPLE 1

The following Solution A and Solution B were added, at the same time, into 1000 ml of an aqueous 2% gelatin solution kept at 40° C. by taking 30 minutes while controlling the pAg and pH to be 6.5 and 3.0, respectively. Further, the following Solution C and Solution D were added, at the same time, thereinto by taking 120 minuted while controlling the pAg and pH to be 7.3 and 5.5, respectively.

At this time, the pAgs were controlled in the method described in JP OPI Publication No. 59-45437/1984 and the pHs were controlled with an aqueous sulfuric acid or sodium hydroxide solution.

| | |
|---|---|
| (Solution A) | |
| Sodium chloride | 3.42 g |
| Potassium bromide | 0.03 g |
| Add water to make | 200 ml |
| (Solution B) | |
| Silver nitrate | 10 g |
| Add water to make | 200 ml |

-continued

| | |
|---|---|
| (Solution C) | |
| Sodium chloride | 102.7 g |
| Potassium bromide | 1.0 g |
| Add water to make | 600 ml |
| (Solution D) | |
| Silver nitrate | 300 g |
| Add water to make | 600 ml |

After completing the above-mentioned addition, a desalting treatment was carried out with an aqueous solution of 5% Demol N (manufactured by Kao-Atlas Corp.) and an aqueous 20% magnesium sulfate solution and the resulting desalted emulsion was mixed with an aqueous gelatin solution, so that monodisperse type cubic emulsion EMP-1 could be prepared so as to have an average grain size of 0.45 μm, a variation coefficient (a standard deviation of grain sizes/an average grain size) of 0.07 and a silver chloride content of 99.5 mol %.

The following compounds were used in EMP-1 and an optimum sensitization was subjected thereto at 65° C., so that green-sensitive silver halide emulsion Em-1 could be prepared.

| | |
|---|---|
| Sodium thiosulfate | 1.5 mg/mol of AgX |
| Stabilizer, SB-5 | $6 \times 10^{-4}$ mols/AgX |
| Sensitizing dye, GS-6 | $3 \times 10^{-4}$ mols/AgX |

Next, Emulsion Em-2 was prepared in the same manner as in Em-1, except that (17) of complex compound I was added in an amount of $1.1 \times 10^{-5}$ mols into Solution C.

Emulsions Em-3 and Em-4 were each prepared in the same manner as in Em-2, except that Compound 17 of Em-2 was replaced by Compounds 6 and 14 each in the amount of the same mols so as to contain in Em-3 and Em-4, respectively.

Em-5 and Em-6 were each prepared for the comparative samples in the same manner as in Em-2, except that Compound 17 of Em-2 was was replaced by IR-1 and IR-2 each in an amount of the same mols so as to contain in Em-5 and Em-6, respectively.

IR-1 $K_2[NiCl_4]$

IR-2 $K_3[CrCl_6]$

Each of the following layers was coated over a polyethylene-laminated paper support containing polyethylene on one side of the support and titanium oxide on the other side of the support, so that Sample 101 could be prepared.

| Layer | Additive | Amount used |
|---|---|---|
| Layer 2 (Protective layer) | Gelatin | 1.0 g/m² |
| Layer 1 (Green-sensitive layer) | Em-1 | 0.36 g/m² (Converted into silver amount contained) |
| | Magenta coupler (MM-1) | 0.35 g/m² |
| | Color image stabilizer (ST-3) | 0.15 g/m² |
| | Color image stabilizer (ST-4) | 0.15 g/m² |
| | Color image stabilizer (ST-5) | 0.15 g/m² |
| | DNP | 0.20 g/m² |

-continued
| Layer | Additive | Amount used |
|---|---|---|
| Support | Polyethylene-laminated paper | DNP: Dinonyl phthalate |
As for the hardener, H-1 was added into Layer 2.
H-1:
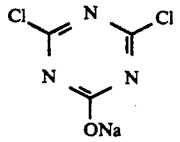
SB-5:
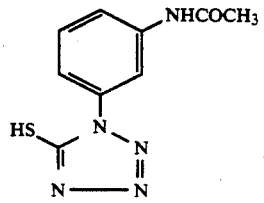
MM-1:
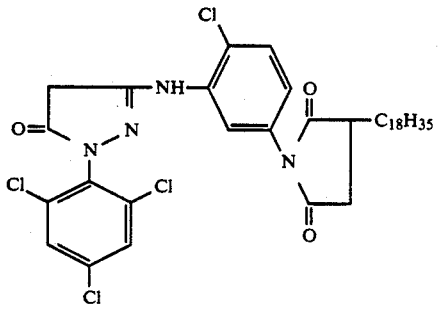
ST-3:
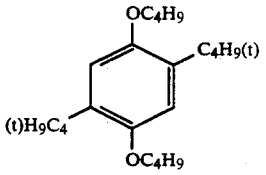
GS-6:
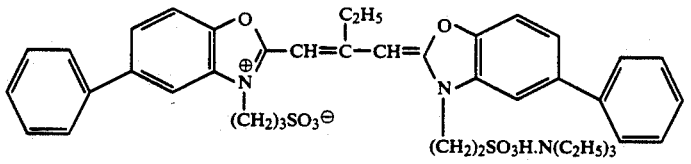
ST-4:
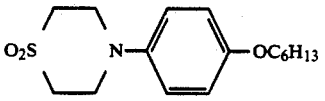
ST-5:

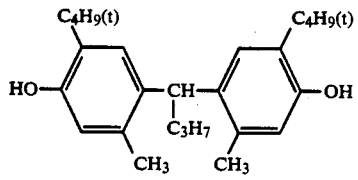

Samples 102 through 106 were each prepared in the same manner as in Sample 101, except that Em-1 of Sample 101 was replaced by Em-2 through Em-6, respectively.

The characteristics of the resulting samples were each evaluated in the following methods. The results thereof are shown in Table 1.

(1) Sensitometry

The resulting samples were each exposed through an optical wedge to green light for 0.05 seconds and were then color-developed in the following processing steps. After completing the developments, the resulting densities of the samples were each measured by an optical densitometer (Model PDA-65 manufactured by Konica Corp.). The measured sensitive speeds thereof were each expressed in the terms of the logarithm of the reciprocals of the exposure quantity necessary to obtain a density 0.8 higher than the fog density.

(2) Reciprocity Law Failure Characteristics

The samples were each exposed to green light through an optical wedge for 10 seconds so as to have the same exposure quantity as in the above-mentioned sensitometry and were then each subjected to the sensitometry. The sensitive speeds of the samples were each expressed in terms of the relative sensitive speeds to that of the same samples exposed for 0.05 seconds which was regarded as a value of 100.

(3) Fog Density

The unexposed samples were each color-developed and the resulting densities thereof were measured by making use of an optical densitometer (Model PDA-65 manufactured by Konica Corp.).

The processing conditions applied to the evaluations were as follows.

| Processing step | Temperature | Time |
|---|---|---|
| Color developing | 35.0 ± 0.3° C. | 45 sec. |
| Bleach-fixing | 35.0 ± 0.5° C. | 45 sec. |
| Stabilizing | 30 to 34° C. | 90 sec. |
| Drying | 60 to 80° C. | 60 sec. |

| Color developer | |
|---|---|
| Pure water | 800 ml |
| Triethanolamine | 10 g |
| N,N-diethyl hydroxylamine | 5 g |
| Potassium bromide | 0.02 g |

-continued

| | |
|---|---|
| Potassium chloride | 2 g |
| Potassium sulfite | 0.3 g |
| 1-hydroxyethylidene-1,1-diphosphonic acid | 1.0 g |
| Ethylenediaminetetraacetic acid | 1.0 g |
| Disodium catechol-3,5-diphosphonate | 1.0 g |
| N-ethyl-N-β-methanesulfonamidoethyl-3-methyl-4-aminoaniline sulfate | 4.5 g |
| Fluorescent whitening agent, (a 4,4'-diaminostilbene disulfonic acid derivative) | 1.0 g |
| Potassium carbonate | 27 g |
| Add water to make in total of | 1 liter |
| Adjust pH to be | pH = 10.10 |
| Bleach-fixer | |
| Ferric ammonium ethylenediamine-tetraacetate, dihydrate | 60 g |
| Ethylenediaminetetraacetic acid | 3 g |
| Ammonium thiosulfate (in an aqueous 70% solution) | 100 ml |
| Ammonium sulfite (in an aqueous 40% solution) | 27.5 ml |
| Add water to make in total of | 1 liter |
| Adjust pH with potassium carbonate or glacial acetic acid to be | pH = 5.7 |
| Stabilizer | |
| 5-chloro-2-methyl-4-isothiazoline-3-one | 1.0 g |
| Ethylene glycol | 1.0 g |
| 1-hydroxyethylidene-1,1-diphosphonic acid | 2.0 g |
| Ethylenediaminetetraacetic acid | 1.0 g |
| Ammonium hydroxide (in an aqueous 20% solution) | 3.0 g |
| Fluorescent whitening agent, (a 4,4'-diaminostilbenedisulfonic acid derivative) | 1.5 g |
| Add water to make in total of | 1 liter |
| Adjust pH with sulfuric acid or potassium hydroxide to be | pH = 7.0 |

TABLE 1

| Sample No. | Emulsion used | Compound [I] used | Sensitive speed | Reciprocity law failure | Remarks |
|---|---|---|---|---|---|
| 101 | Em-1 | — | 100 | 67 | Comparison |
| 102 | Em-2 | I-17 | 180 | 89 | Invention |
| 103 | Em-3 | I-6 | 179 | 86 | Invention |
| 104 | Em-4 | I-14 | 175 | 85 | Invention |
| 105 | Em-5 | IR-1 | 95 | 77 | Comparison |
| 106 | Em-6 | IR-2 | 104 | 66 | Comparison |

As is obvious from the above-given Table 1, the samples of the invention are proved to be each high in sensitive speed and improved in reciprocity law failure characteristics.

EXAMPLE 2

Em-7 and Em-8 were each prepared in the same manner as in Em-1 and Em-2, except that sodium chloroaurate and SB-5 were used in Em-1 and Em-2 at the time when each of the chemical sensitization was carried out, respectively.

Samples 107 and 108 were each prepared by coating the resulting Em-7 and Em-8 thereon in the same manner as in Em-1, and they were each evaluated in the same manner as in Example 1.

The results of the evaluation are shown in Table 2.

TABLE 2

| Sample No. | Emulsion used | Sodium chloroaurate | Compound I | Sensitivity | Reciprocity law failure | Remarks |
|---|---|---|---|---|---|---|
| 102 | Em-2 | Used | I-17 | 180 | 89 | Invention |
| 108 | Em-8 | Not used | I-17 | 300 | 82 | Invention |
| 101 | Em-1 | Not used | — | 100 | 67 | Comparison |
| 107 | Em-7 | Used | — | 208 | 54 | Comparison |

From the comparisons between Sample 107 and Sample 108 and between Sample 102 and Sample 101, it was proved to be particularly excellent in the sensitization effects of the invention when making the sensitization with sodium chloroaurate.

It was also proved to be particularly excellent in the reciprocity law failure improvement effects of the invention when making the sensitization with sodium chloroaurate. In other words, it was proved that the emulsions particularly subjected to the sensitization with sodium chloroaurate were excellent in the sensitization effects and the reciprocity law failure improvement effects, which were displayed by making use of Compound I.

EXAMPLE 3

A monodisperse type cubic emulsion having an average grain size of 0.71 μm i.e., an average side length of the cubes, a variation coefficient of 0.07 and a silver chloride content of 99.5 mol % was prepared in the same manner as in EMP-1 of Example 1, except that the times for adding a pair of Solution A and Solution B and a pair of Solution C and Solution D were changed, respectively. The resulting emulsion was subjected to the optimum sensitization at 67° C. by making use of sodium thiosulfate in an amount of 2.0 mg/mol of AgX, SB-5 in an amount of $7\times10^{-4}$ mols/mol of AgX and sensitizing dye RS-7 in an amount of $7\times10^{-5}$ mols/mol of AgX. The resulting emulsion is called Em-9.

An emulsion was prepared in the same manner as in Em-9, except only that Solution C of Em-9 was further added with I-17 in an amount of $1\times10^{-5}$ mols/mol of AgX. The resulting emulsion is called Em-10.

Two emulsions were prepared in the same manner as in Em-9 and Em-10, except only that sodium chloroaurate were each added in an amount of 1.5 mg/mol of AgX when sensitizing Em-9 and Em-10, respectively. The resulting emulsions are called Em-11 and Em-12.

A monodisperse type cubic emulsion having an average grain size of 0.52 μm i.e., an average side length of the cubes, a variation coefficient of 0.07 and a silver chloride content of 99.5 mol % was prepared in the same manner as in EMP-1 of Example 1, except that the times for adding a pair of Solution A and Solution B and a pair of Solution C and Solution D were changed, respectively. The resulting emulsion was subjected to the optimum sensitization at 67° C. by making use of sodium thiosulfate in an amount of 2.0 mg/mol of AgX, SB-5 in an amount of $7\times10^{-4}$ mols/mol of AgX and sensitizing dye RS-7 in an amount of $7\times10^{-5}$ mols/mol of AgX. The resulting emulsion is called Em-13.

An emulsion was prepared in the same manner as in Em-13, except only that Solution C of Em-13 was further added with I-17 in an amount of $1.4\times10^{-5}$ mols/mol of AgX. The resulting emulsion is called Em-14.

Two emulsions were prepared in the same manner as in Em-13 and Em-14, except only that sodium chloroaurate were each added in an amount of 0.3 mg/mol of AgX when sensitizing Em-13 and Em-14, respectively. The resulting emulsions are called Em-15 and Em-16.

Next, the layers having the following compositions were each coated over a polyethylene-laminated paper support containing polyethylene on one side of the support and titanium on the other side thereof i.e., the side to which a photographic component layer is to be coated, so that a multilayered silver halide color photographic light sensitive material sample 201 could be prepared. The coating solutions were each prepared in the following manners, respectively.

Coating Solution for Layer 1

Ethyl acetate of 60 ml was added to be dissolved in yellow coupler YY-1 of 26.7 g, 10.0 g of dye-image stabilizer ST-1, 6.67 g of ST-2, 0.67 g of additive HQ-1 and 6.67 g of high-boiling organic solvent DNP. The resulting solution was dispersed in 220 ml of an aqueous 10% gelatin solution containing 7 ml of a 20% surfactant SU-1 by making use of a supersonic homogenizer, so that a yellow coupler dispersion could be prepared. The resulting dispersion solution was further added by antimold B-1. The resulting dispersion solution was mixed with a blue-sensitive silver halide emulsion containing 10 g of silver prepared under the following conditions, so that the coating solution for Layer 1 could be prepared.

The coating solutions each for Layer 2 through Layer 7 were also prepared in the same manner as in the above-mentioned coating solution for Layer 1.

| Layer | Composition | Amount added ($g/m^2$) |
|---|---|---|
| Layer 7 (Protective layer) | Gelatin | 1.0 |
| Layer 6 (UV absorbing layer) | Gelatin | 0.4 |
| | UV absorbent (UV-1) | 0.10 |
| | UV absorbent (UV-2) | 0.04 |
| | UV absorbent (UV-3) | 0.16 |
| | Antistaining agent (HQ-1) | 0.01 |
| | DNP | 0.2 |
| | PVP | 0.03 |
| Layer 5 (Red-sensitive layer) | Gelatin | 1.00 |
| | Red-sensitive silver chlorobromide emulsion (Em-12), in terms of silver content | 0.24 |
| | Cyan coupler (CC-1) | 0.29 |
| | Cyan coupler (CC-2) | 0.10 |
| | Dye-image stabilizer (ST-1) | 0.20 |
| | Antistaining agent (HQ-1) | 0.01 |
| | HBS-1 | 0.20 |
| | DOP | 0.20 |
| Layer 4 (UV absorbing layer) | Gelatin | 0.94 |
| | UV absorbent (UV-1) | 0.28 |
| | UV absorbent (UV-2) | 0.09 |
| | UV absorbent (UV-3) | 0.38 |
| | Antistaining agent (HQ-1) | 0.03 |
| | DNP | 0.04 |
| Layer 3 (Green-sensitive layer) | Gelatin | 1.40 |
| | Green-sensitive silver chlorobromide emulsion (Em-1) in terms of silver content | 0.36 |
| | Magenta coupler (MM-1) | 0.35 |

-continued

| Layer | Composition | Amount added ($g/m^2$) |
|---|---|---|
| | Dye-image stabilizer (ST-3) | 0.15 |
| | Dye-image stabilizer (ST-4) | 0.15 |
| | Dye-image stabilizer (ST-5) | 0.15 |
| | DNP | 0.20 |
| Layer 2 (Interlayer) | Gelatin | 1.20 |
| | Antistaining agent (HQ-2) | 0.12 |
| | DIDP | 0.15 |
| Layer 1 (Blue-sensitive layer) | Gelatin | 1.20 |
| | Blue-sensitive silver chlorobromide emulsion (Em-9) in terms of silver content | 0.30 |

-continued

| Layer | Composition | Amount added ($g/m^2$) |
|---|---|---|
| | Yellow coupler (YY-1) | 0.80 |
| | Dye-image stabilizer (ST-1) | 0.30 |
| | Dye-image stabilizer (ST-1) | 0.20 |
| | Antistaining agent (HQ-1) | 0.02 |
| | DNP | 0.20 |
| Support | Polyethylene-laminated paper | |

Water-soluble dyes AI-1, AI-2 and AI-3 were added into the coating solutions for Layer 1, Layer 3 and Layer 6, respectively. The compositions of the additives used therein were as follows.

YY-1

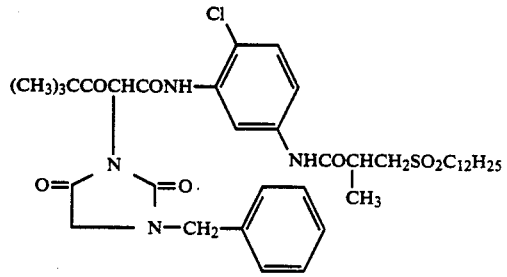

CC-1

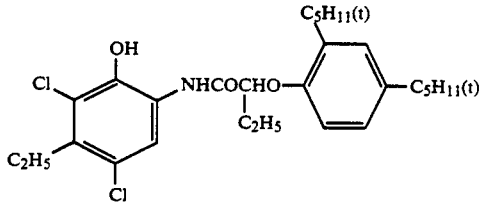

CC-2

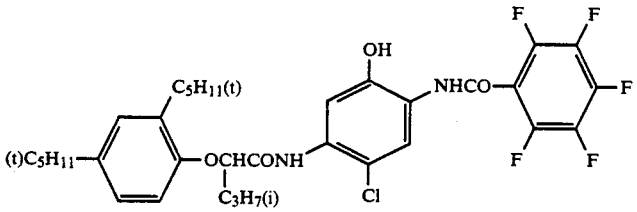

BS-3

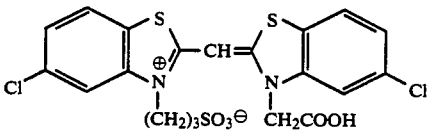

ST-1

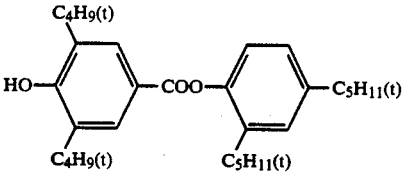

ST-2

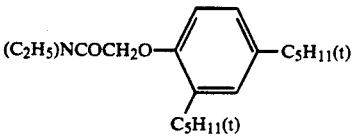

-continued
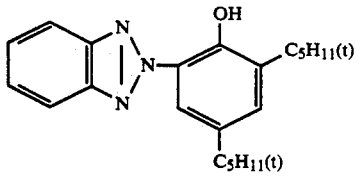
UV-1
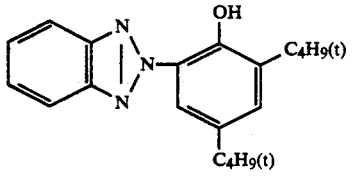
UV-2
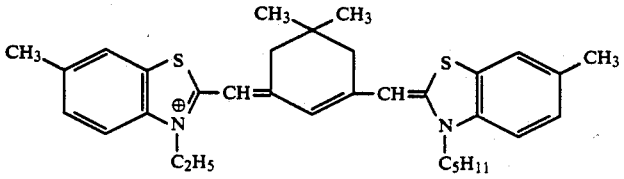
RS-7
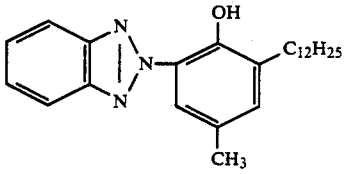
UV-3
DOP: Dioctyl phthalate
DIDP: Diisodecyl phthalate
PVP: Polyvinyl pyrrolidone
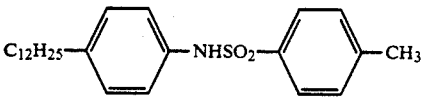
HBS-1
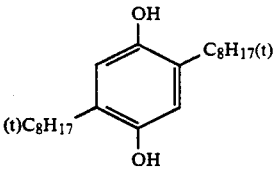
HQ-1
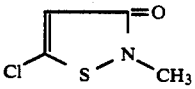
B-1
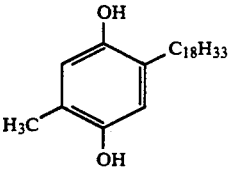
HQ-2
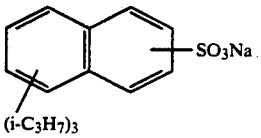
SU-1

-continued

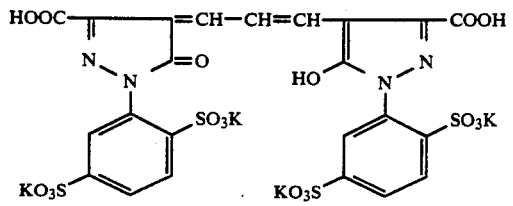

AI-2

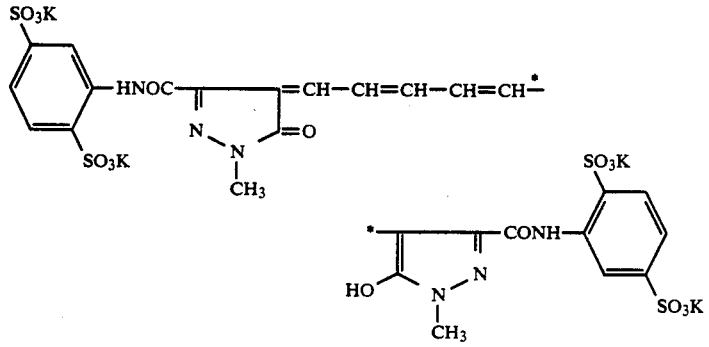

AI-3

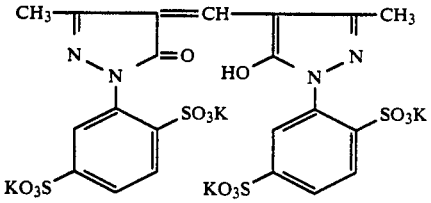

AI-1

As for the hardeners, H-2 were each added to Layers 2 and 4 and H-1 to Layer 7, respectively.

| | | |
|---|---|---|
| H-2: | $C(CH_2SO_2CH{=}CH_2)_4$ | 0.07 g/m$^2$ |
| H-1: | | 0.05 g/m$^2$ |

Samples 202 through 204 were each prepared in the same manner as in Sample 201, except that the emulsions used in the light sensitive silver halide layers of Sample 201 were replaced by those shown in Table 3.

TABLE 3

| Sample No. | Blue-sensitive emulsion layer | Green-sensitive emulsion layer | Red-sensitive emulsion layer | Inventive compound I | Sensitization made by chloro-auric acid |
|---|---|---|---|---|---|
| 201 | Em-9 | Em-1 | Em-13 | Not used | Not done |
| 202 | Em-10 | Em-2 | Em-14 | Used | Not done |
| 203 | Em-11 | Em-7 | Em-15 | Not used | Done |
| 204 | Em-12 | Em-8 | Em-16 | Used | Done |

By making use of the resulting samples, the exposures and processes were tried in the same manner as in Example 1, except that each of blue-, green- and red-filters were used in place of the filters used in Example 1 when making the exposures. Each of the evaluation thereof was made in the same manners as in Example 1. The sensitive speeds of the samples were expressed in terms of the values relative to the sensitive speed of Sample 201 which was regarded as a value of 100. The resulting fog densities thereof were measured by making use of an optical densitometer (Model PDA-65 manufactured by Konica Corp.) and the fog values thereof were relatively expressed in terms of the values relative to the fog values obtained from each of the color sensitive layers of Sample 201 as regarded as a value of 0.00. The values of resiprocity failure are those of the green sensitive layers of the samples. The results of the evaluation are shown in Table 4.

TABLE 4

| | Sample | Sensitive speed | Reciprocity law failure characteristics | Fog | Remarks |
|---|---|---|---|---|---|
| 201 | Blue-sensitive layer | 100 | 68 | 0.00 | Comparison |
| | Green-sensitive layer | 100 | | 0.00 | |
| | Red-sensitive layer | 100 | | 0.00 | |
| 202 | Blue-sensitive layer | 177 | 83 | 0.00 | Invention |
| | Green-sensitive layer | 176 | | 0.00 | |
| | Red-sensitive layer | 174 | | +0.01 | |

TABLE 4-continued

| | Sample | Sensitive speed | Reciprocity law failure characteristics | Fog | Remarks |
|---|---|---|---|---|---|
| 203 | Blue-sensitive layer | 202 | 56 | +0.02 | Comparison |
| | Green-sensitive layer | 204 | | +0.02 | |
| | Red-sensitive layer | 203 | | +0.01 | |
| 204 | Blue-sensitive layer | 307 | 81 | +0.01 | Invention |
| | Green-sensitive layer | 306 | | +0.01 | |
| | Red-sensitive layer | 303 | | 0.00 | |

It is found from Table 4 that the great effects of the invention are also displayed in multilayered silver halide color light sensitive materials. Particularly in Sample 204 which was chemically sensitized by making use of sodium chloroaurate, the reciprocity law failure improvement effects could remarkably be displayed and the highly sensitive speed could be provided, as compared to Comparative Sample 203 which was also sensitized in the same manner as in Sample 204.

In other words, in the samples chemically sensitized with sodium chloroaurate, it was proved that the invention could display the great effects on the reciprocity law failure improvements and the samples each having a highly sensitive speed could also be obtained.

EXAMPLE 4

Highly concentrated polyethylene was laminated over the both sides of paper pulp having a weighed amount of 180 g/m$^2$, so that a paper support could be prepared. Further, surface-treated fused-polyethylene in which anatase type titanium oxide was dispersed in a proportion of 13% by weight was laminated over the resulting support on the side where an emulsion layer is to be coated, so that a reflective support could be prepared. The dispersed degrees of the titanium oxide was proved to be 0.19 when measured in the method described in JP OPI Publication No. 2-28640/1990. Then, each of the layers having the following compositions was coated on the resulting reflective support, so that multilayered silver halide photographic light sensitive material Sample 301 could be prepared. The coating solutions were prepared in the following manners.

Ethyl acetate of 60 ml was added to be dissolved in yellow coupler Y-1 of 26.7 g, 10.0 g of dye-image stabilizer ST-1, 6.67 g of ST-2, 0.67 g of additive HQ-1 and 6.67 g of high-boiling organic solvent DNP. The resulting solution was dispersed in 220 ml of an aqueous 10% gelatin solution containing 9.5 ml of a 15% surfactant SU-1 by making use of a supersonic homogenizer, so that a yellow coupler dispersion could be prepared. The resulting dispersion was mixed with an infrared-sensitive silver halide emulsion Em-IR1, which contained 8.68 g of silver, prepared under the following conditions and, further, 6.7 ml of an aqueous 5% antiirradiation dye AI-5 solution was added thereinto, so that the coating solution for Layer 1 could be prepared. The coating solutions each for Layer 2 through Layer 7 were also prepared in the same manner as in the above-mentioned coating solution for Layer 1. As for the layer hardeners, H-2 were each added to Layers 2 and 4 and H-1 to Layer 7, respectively. As for the surfactants, SU-2 and SU-3 were also added so that the surface tensions of the resulting coating solutions could be adjusted.

The layer compositions were shown in Tables 1 and 2 given below.

| Layer | Composition | Amount added (g/m$^2$) |
|---|---|---|
| Layer 7 (Protective layer) | Gelatin | 1.0 |
| | Antimold (B-1) | 0.002 |
| Layer 6 (UV absorbing layer) | Gelatin | 0.40 |
| | UV absorbent (UV-1) | 0.10 |
| | UV absorbent (UV-2) | 0.04 |
| | UV absorbent (UV-3) | 0.16 |
| | Antistaining agent (HQ-1) | 0.01 |
| | DNP | 0.20 |
| | PVP | 0.03 |
| | Antiirradiation dye (AI-3) | 0.02 |
| Layer 5 (Red-sensitive layer) | Gelatin | 1.30 |
| | Red-sensitive silver chlorobromide emulsion (Em-R1) | 0.21 |
| | Cyan coupler (C-1) | 0.42 |
| | Dye-image stabilizer (ST-1) | 0.20 |
| | Antistaining agent (HQ-1) | 0.01 |
| | HBS-1 | 0.20 |
| | DOP | 0.20 |
| Layer 4 (UV absorbing layer) | Gelatin | 0.94 |
| | UV absorbent (UV-1) | 0.28 |
| | UV absorbent (UV-2) | 0.09 |
| | UV absorbent (UV-3) | 0.38 |
| | Antistaining agent (HQ-1) | 0.03 |
| | DNP | 0.40 |
| | Antiirradiation dye (AI-4) | 0.01 |
| Layer 3 (Infrared-sensitive layer) | Gelatin | 1.40 |
| | Infrared-sensitive silver chlorobromide emulsion (Em-IR2) | 0.17 |
| | Magenta coupler (M-1) | 0.35 |
| | Dye-image stabilizer (ST-3) | 0.15 |
| | Dye-image stabilizer (ST-4) | 0.15 |
| | Dye-image stabilizer (ST-5) | 0.15 |
| | DNP | 0.20 |
| Layer 2 (Interlayer) | Gelatin | 1.20 |
| | Antistaining agent (HQ-2) | 0.12 |
| | DIDP | 0.15 |
| | Antimold (B-1) | 0.002 |
| | Antiirradiation dye (AI-3) | 0.01 |
| Layer 1 (Infrared-sensitive layer) | Gelatin | 1.20 |
| | Infrared-sensitive silver chlorobromide emulsion (Em-IR1) | 0.26 |
| | Yellow coupler (Y-1) | 0.80 |
| | Dye-image stabilizer (ST-1) | 0.30 |
| | Dye-image stabilizer (ST-2) | 0.20 |
| | Antistaining agent (HQ-1) | 0.02 |
| | DNP | 0.20 |
| Support | Polyethylene-laminated paper | |

In the table, the amounts of the silver halide emulsion are indicated in terms of the silver contents thereof.

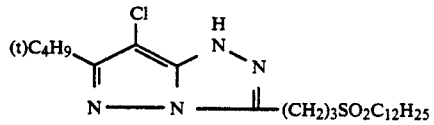

M-1

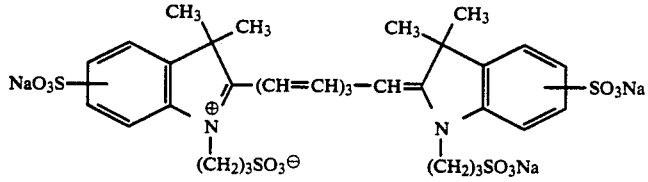

AI-4

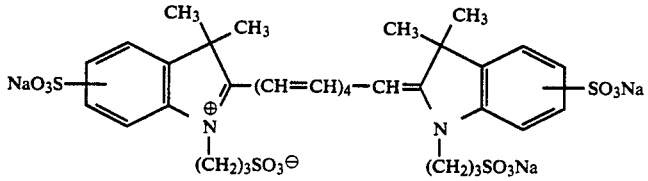

AI-5

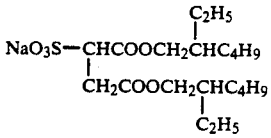

SU-2

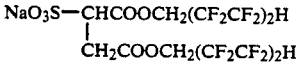

SU-3

Preparation of Infrared Light Sensitive Silver Halide Emulsion EM-IR1

The following Solution A and Solution B were each added at the same time into 1000 ml of an aqueous 2% gelatin solution being kept at 40° C. by taking 15 minutes while controlling the pAg and pH to be 6.5 and 3.0, respectively. The, Solution C and Solution D were further added at the same time into the resulting mixed solution by taking 110 minutes while controlling the pAg and pH to be 7.3 and 5.5, respectively. At this time, the pAg was controlled in the method described in JP OPI Publication No. 59-45437 (1984) and the pH was controlled with an aqueous sulfuric acid or sodium hydroxide solution.

| | |
|---|---|
| (Solution A) | |
| Sodium chloride | 3.42 g |
| Potassium bromide | 0.03 g |
| Add water to make | 200 ml |
| (Solution B) | |
| Silver nitrate | 10 g |
| Add water to make | 200 ml |
| (Solution C) | |
| Sodium chloride | 102.7 g |
| Potassium bromide | 1.0 g |
| Add water to make | 600 ml |
| (Solution D) | |
| Silver nitrate | 300 g |
| Add water to make | 600 ml |

After completing the addition, a desalting treatment was carried out by making use of an aqueous solution of 5% Demol N (manufactured by Kao-Atlas Corp.) and an aqueous solution of 20% magnesium sulfate. After then, the desalted emulsion was mixed with an aqueous gelatin solution, so that a monodisperse type cubic emulsion EMP-11 could be prepared so as to have an average grain size of 0.42 μm, a variation coefficient of 0.07 and a silver chloride content of 99.5 mol %.

The above-mentioned emulsion EMP-11 was chemically sensitized by making use of the following compounds, so that infrared light sensitive silver halide emulsion Em-IR1.

| | |
|---|---|
| Sodium thiosulfate | 1.5 mg/mol of AgX |
| Chloroauric acid | 1.0 mg/mol of AgX |
| Stabilizer, SB-5 | $0.6 \times 10^{-4}$ mols/mol of AgX |

SB-5 was added by taking a time for which the optimum sensitometric characteristics can be obtained and the chemical sensitization was stopped in reaction by lowering the temperature, provided, 3 minutes before adding SB-5, an infrared sensitizing dye IRS-11 was added and a spectral sensitization was then carried out.

Preparation of Infrared Light Sensitive Silver Halide Emulsion Em-IR2

An infrared light sensitive emulsion Em-IR2 was prepared in the same manner as in the preparation of the infrared light sensitive silver halide emulsion Em-IR1, except that sensitizing dye IRS-11 was replaced by IRS-7.

Preparation of a Red Light Sensitive Silver Halide Emulsion Em-R1

A monodisperse type cubic emulsion EMP-12 having an average grain size of 0.50 μm, a variation coefficient (S/R) of 0.08 and a silver chloride content of 99.5 mol % was prepared in the same manner as in EMP-11, except that the adding time of Solution A and Solution B and the adding time of Solution C and Solution D were each changed. The resulting EMP-12 was chemically sensitized at 60° C. for 90 minutes by making use of red sensitive sensitizing dye RS-1, so that red light sensitive silver halide emulsion EM-R1 could be prepared.

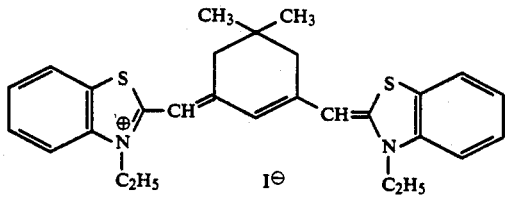

RS-1

Next, Em-IR3 and Em-IR4 were each prepared in the same manner as in the preparations of the emulsions Em-IR2 and Em-IR2, except that the exemplified complex compound I-17 was added into Solution C.

Exemplified compound I-17 was so added as to be $10^{-6}$ mols per mol of the finally produced silver halide.

Red sensitive emulsion Em-R2 was also prepared in the same manner as in emulsion Em-R1, except that Exemplified compound I-17 of the heavy metal compounds was added into Solution C.

Exemplified compound I-17 was so added as to be $10^{-6}$ mols per mol of the finally produced silver halide.

Sample 302 was also prepared in the same manner as in the preparation of Sample 301, except that the infrared sensitive emulsion Em-IR1 of Sample 1 was replaced by an infrared sensitive emulsion Em-IR3; the infrared sensitive emulsion Em-IR2 of Sample 1, by an infrared sensitive emulsion Em-IR4; and the red sensitive emulsion Em-R1 of Sample 1, by a red sensitive emulsion Em-R2; respectively.

As shown in the table, each of the emulsions and each of couplers (C), (M) and (Y) were used in combination, so that silver halide photographic light sensitive materials 301 and 302 were each prepared.

| Sample No. | (C) | (M) | (Y) |
|---|---|---|---|
| 301 | Em-R1 | Em-IR2 | Em-IRI |
| 302 | Em-R2 | Em-IR4 | Em-IR3 |

An aluminium.gallium.indium.phosphorus semiconductor laser generating light of about 670 nm, a gallium-.aluminium.arsenic semiconductor laser generating light of about 780 nm and a gallium.aluminium.arsenic semiconductor laser generating light of about 830 nm, which serve together as an exposure means for light sensitive materials, were assembled into an optical system. The light emitted from the three lasers were condensed into a single beam after the light was modulated according to an image data, so that a silver halide photographic light sensitive material being transported at a speed of 20 mm/second can be scanned and exposed to the resulting beam at a main scanning speed of 160 m/second at right angles to the direction of transporting the light sensitive material. At this time, the diameter of the beam was about 80 μm and the exposure time per pixel was 500 nanoseconds.

The above-mentioned modulation was carried out in the system of varying the times of outputting the lasers so as to obtain patches each having a density difference of about 0.10 between 0.3 and 1.6 on a print. At this time, the shorted exposure time was about 2 nanoseconds, because the outputting image data of 8 bits were set. The above-mentioned exposure means was operated and 30 sets of the patches were output. The resulting patches were developed in the conditions of Example 2, so that the samples could be obtained.

The resulting samples were subjected to the density measurements by making use of a densitometer, Model PDA-65 (manufactured by Konica Corp.). With respect to the patches each having a specific density, the average values and standard deviations of the density values measured by green light thereof are shown in the following Table 5. In the table, the standard deviations are given in parenthesises.

TABLE 5

| Density set to be formed | Sample No. 301 | Sample No. 302 |
|---|---|---|
| 30 | 31(1) | 30(1) |
| 40 | 41(1) | 41(1) |
| 50 | 52(2) | 50(1) |
| 60 | 60(2) | 61(1) |
| 70 | 68(2) | 70(2) |
| 80 | 80(3) | 81(2) |
| 90 | 88(3) | 92(2) |
| 100 | 97(3) | 100(2) |
| 110 | 110(3) | 111(3) |
| 120 | 119(3) | 120(2) |
| 130 | 131(3) | 131(3) |
| 140 | 139(3) | 141(2) |
| 150 | 149(3) | 151(2) |
| 160 | 162(3) | 162(2) |

In comparison of the results of Comparative Sample No. 301 with those of Sample No. 302 relating to the invention, it was proved that the samples of the invention each could more reduce both of any shift or scatter from the set values. When the shifts between the straight regression line and the measured value were evaluated by the print density was revolved linearly to the set value, the standard deviation values of Sample Nos. 301 and 302 became 1.5 and 0.6, respectively. It was, therefore, proved that the standard deviations of the samples of the invention were made smaller. When the inclination of the straight line is shifted from one (1), it will produce an image contrast variation. However, there was no problem, because the variation thereof was of the order of 1%.

The following Tables 6 and 7 show the average values and standard deviations of both densities measured by blue light and red light, respectively. Each of the tables indicates that the samples of the invention could display the effects of the invention.

TABLE 6

| Blue density | Sample No. 301 | Sample No. 302 |
|---|---|---|
| 30 | 30(1) | 30(1) |
| 70 | 68(2) | 71(1) |
| 110 | 112(3) | 110(2) |
| 160 | 162(3) | 162(2) |

TABLE 7

| Blue density | Sample No. 301 | Sample No. 302 |
|---|---|---|
| 30 | 32(1) | 31(1) |
| 70 | 68(2) | 71(1) |
| 110 | 110(3) | 110(2) |
| 160 | 162(3) | 161(2) |

From the results of the above-given tables, it was proved that the effects of the invention could be displayed not only in the density measured by green light, but also in blue and red densities, similarly.

EXAMPLE 4

Sample 401 was prepared in the same manner as in Sample 302 of Example 1, except that the yellow coupler and magenta coupler were replaced by YC-1 and MC-1, respectively; and, Sample 401 was prepared in the same manner as in Sample 302 of Example 1, except that the yellow coupler and magenta coupler were replaced by YC-2 and MC-4, respectively.

| Sample No. | Yellow coupler | Magenta coupler |
|---|---|---|
| 401 | YC-1 | MC-1 |
| 402 | YC-2 | MC-4 |

Samples 401, 402 and 302 were each scanned and exposed by making use of the scanning exposure means described in Additional Example 1, so that the yellow color patch and magenta color patch each having a density of 2.0. The metric hue angles and metric chroma of the resulting color patches were obtained in the foregoing method. Thus, the results listed in Table 8 were obtained.

TABLE 8

| | | | Yellow color patch | | Magenta color patch | |
|---|---|---|---|---|---|---|
| | | | Metric hue angle | Metric chroma | Metric hue angle | Metric chroma |
| 302 | YC-1 | M-1 | 88.2° | 87.2 | 340.5° | 68.7 |
| 401 | YC-1 | MC-1 | 88.2° | 87.4 | 346.6° | 74.4 |
| 402 | YC-2 | MC-4 | 89.1° | 85.2 | 345.0° | 70.3 |

The following 4 scenes were each photographed so as to prepare the corresponding color slides, respectively. The resulting color slide images were read through a scanner to convert them into the digital image data and the printed images were obtained from the resulting data by making use of the above-mentioned scanning exposure means. The resulting images were exhibited to 10 people as the subjects asking them to evaluate the images sensibly from the viewpoint of color reproduction. The results were evaluated in the 5-grade evaluation system in which the inferior was graded as 1 point and the superior was graded as 5 points.

The photographed scenes subject to the evaluation were as follows:

(1) a woman's portrait,
(2) a group photograph,
(3) a mountain scenery photograph, and
(4) a recreation ground photograph The results given in Table 9 were obtained.

TABLE 9

| | Scene | | | |
|---|---|---|---|---|
| | (1) | (2) | (3) | (4) |
| 302 | 3.3 | 3.4 | 3.2 | 3.1 |
| 401 | 3.8 | 3.6 | 3.8 | 3.9 |
| 402 | 3.7 | 3.7 | 3.5 | 3.6 |

An excellent photographic image can be provided by scanning and exposing the silver halide photographic light sensitive materials relating to the invention to light. However, a printed image more excellent in color reproducibility can also be provided by selecting yellow and magenta couplers.

We claim:

1. A silver halide color photographic light-sensitive material comprising a support having thereon a silver halide emulsion layer containing silver halide grains which have been formed in the presence of a complex of rhenium, molybdenum, iridium, rhodium, ruthenium, osmium, cadmium, zinc, palladium, platinum, gold, iron, nickel, cobalt, tungsten, or chromium each having at least one cyanate ligand, isocyanate ligand or fulminate ligand, and wherein said silver halide grains comprises silver chloride in an amount of 95 mol % or more and essentially no silver iodide.

2. The light-sensitive material of claim 1, wherein said silver halide grains comprises silver chloride in an amount of 98 mol % to 99.5 mol % and silver bromide in an amount of 0.1 mol % to 2 mol %.

3. The light-sensitive material of claim 1, wherein said complex is a complex of rhenium, ruthenium, osmium, iron, or palladium.

4. The light-sensitive material of claim 3, wherein said complex is a complex of rhenium, ruthenium, osmium or iron.

5. The light-sensitive material of claim 1, wherein said silver halide grains are formed in the presence of said complex in an amount of $1\times10^{-9}$ to $1\times10^{-2}$ moles per mol of silver halide.

6. The light-sensitive material of claim 5, wherein said silver halide grains are formed in the presence of said complex in an amount of $1\times10^{-6}$ to $1\times10^{-4}$ moles per mol of silver halide.

7. The light-sensitive material of claim 5 wherein said complex is selected from the group consisting of one of the following complexes:

| | |
|---|---|
| (1) $[Ru(CNO)_6]^{4-}$ | (2) $[Os(CNO)_6]^{4-}$ |
| (3) $[OsO_2(CNO)\text{-}4]^{2-}$ | (4) $[Rh(CNO)_6]^{3-}$ |
| (5) $[Ir(CNO)_6]^{3-}$ | (6) $[Zn(CNO)_4]^{2-}$ |
| (7) $[Cd(CNO)_4]^{2-}$ | (8) $[Pd(CNO)_4]^{2-}$ |
| (9) $[Pt(CNO)_4]^{2-}$ | (10) $[Ni(CNO)_4]^{2-}$ |
| (11) $[Au(CNO)_2]^{-}$ | (12) $[Cr(CO)_4(CNO)_2]^{2-}$ |
| (13) $[Mo(CO)_4(CNO)_2]^{2-}$ | (14) $[W(CO)_4(CNO)_2]^{2-}$ |
| (15) $[Co(CNO)_6]^{3-}$ | (16) $[Co_2(CNO)_{11}]^{5-}$ |
| (17) $[Fe(CNO)_6]^{4-}$ | (18) $[Fe(CN)_5CNO]^{4-}$ |
| (19) $[Cr(CO)_5CNO]^{-}$ | (20) $[Pt(CNO)_2Br_2]^{2-}$ |
| (21) $[Mo(OCN)_6]^{3-}$ | (22) $[Re(CNO)_6]^{3-}$ |
| (23) $[Re(OCN)_6]^{4-}$ | (24) $[Re(NCO)_6]^{3-}$ |
| (25) $[Ru(NCO)_6]^{3-}$ | (26) $[Ru(NCO)_6]^{4-}$ |
| (27) $[Os(NCO)_6]^{3-}$ | (28) $[Os(OCN)_6]^{3-}$ |
| (29) $[Fe(NCO)_6]^{3-}$ | (30) $[Fe(OCN)_6]^{3-}$. |

8. The light-sensitive of claim 5, wherein the cyanate ligand is present.

9. The light-sensitive material of claim 5, wherein the isocyanate ligand is present.

10. The light-sensitive material claim 5, wherein the fulminate ligand is present.

* * * * *